United States Patent [19]

Mumford et al.

[11] Patent Number: 4,555,415

[45] Date of Patent: Nov. 26, 1985

[54] VITREOUS ENAMELS

[75] Inventors: John L. C. Mumford, Saffron Walden; Roger F. Price, Haverhill, both of England

[73] Assignee: TI (Group Services) Limited, Birmingham, England

[21] Appl. No.: 683,617

[22] Filed: Dec. 19, 1984

[30] Foreign Application Priority Data

Dec. 21, 1983 [GB] United Kingdom ..... 8334118

[51] Int. Cl.[4] ..... B05D 3/02

[52] U.S. Cl. ..... 427/193; 427/201; 427/376.2; 427/376.3; 427/376.4

[58] Field of Search ..... 427/193, 201, 376.2, 427/376.3, 376.4

[56] References Cited

U.S. PATENT DOCUMENTS 1,996,840 4/1934 Staley ..... 427/376.4
3,649,327 3/1972 Gornall ..... 427/193
4,221,824 9/1980 Leonard et al. ..... 427/193 X
4,265,929 5/1981 Wagner et al. ..... 427/193 X

FOREIGN PATENT DOCUMENTS 2829959 1/1980 Fed. Rep. of Germany .

*Primary Examiner*—Shrive P. Beck
*Attorney, Agent, or Firm*—Kemon & Estabrook

[57] ABSTRACT

A process for applying a vitreous enamel comprises applying a powdered vitreous frit to a metal, said frit having a water content of up to 0.03% by weight; this coated metal then being fired at a temperature in excess of the melting point of the frit, in a furnace having an atmosphere with a dew point of up to 10° C. Metal particles may be admixed with the powdered frit to form a cermet or glass/metal composite. The powdered frit may be applied to a substrate as a non-aqueous slurry or an aqueous slurry including a polysaccharide based suspension agent.

15 Claims, 23 Drawing Figures

VITREOUS ENAMELS

This invention relates to vitreous enamels and in particular to a method of applying vitreous enamels to form a coating on a substrate.

When applying vitreous enamels to some metal substrates such as steel, various defects are liable to occur in the coating. The major defects which occur with steel are: (a) carbon boil defects, and (b) fishscaling. If metal particles are incorporated in the enamel foaming of the enamel layer resulting in a porous coating may be a serious problem.

Carbon boil defects are generally attributed to interaction between the enamel and carbon in the steel surface. This interaction causes black specks and in severe cases the surface of the enamel may be blistered. To reduce this problem to an acceptable level it has been necessary to produce special "enamelling grade" steels in which the carbon content is reduced to below about 0.030% by weight. Even so with light coloured or white finish enamels a second application of enamel is required to provide an acceptable finish. Special steels in which the carbon content is reduced to below about 0.008% by weight will accept a direct application of white enamel without any significant carbon boil defects.

Fishscaling is where the enamel peels away from the steel substrate to form a characteristic "fishscale" pattern. Again the steel substrate may be treated or the enamel applied by special techniques to avoid this problem and generally it is found that cold rolled steel is much less susceptible to this defect than hot rolled material. Nevertheless, this problem severely restricts the types of steel that may be enamelled without expensive pre-treatment of the steel or adopting special enamel compositions.

Similar problems also occur with other metallic substrates, in particular those metals that have an affinity for oxygen, such as aluminium, magnesium, titanium, zirconium, silicon and their alloys.

Furthermore, it is known that the addition of metal particles, in particular aluminium and like metals, to vitreous enamels to form a cermet, provides enamels of greater toughness, high temperature resistance and with improved adhesion to steel substrates. However, these coatings are prone to foaming during their preparation resulting in porous coatings. When these coatings are used as self-clean oven finishes this porosity is advantageous since it ensures a large surface area for the catalytic oxidation of cooking soil. However when vitreous enamel cermet coatings containing aluminium particles are required to provide oxidation and corrosion protection to a metal substrate, this foaming and porosity is undesirable.

Vitreous enamel coatings are formed from glass or frit compositions which are applied to the substrate in the form of a powder and are then fused to form a continuous coating. The frit is frequently applied to the substrate as a slurry in which finely divided particles of the frit are maintained in an aqueous suspension by suspension agents such as clay, plus other additions to control the properties of the slurry and the final properties of the coating after firing. When aluminium powder is added to enamel slurry there is a tendency for the aluminium to react with the slurry, producing gaseous hydrogen.

In U.S. Pat. No. 2,900,276 the reaction between a vitreous enamel slurry and aluminium powder is prevented by using an enamel frit consisting essentially of three parts boron oxide to one part barium oxide. This frit is claimed to be relatively insoluble in the water used for the slurry.

In German Pat. No. 2829959 a frit composition range is claimed such that when it is used in a slurry and aluminium powder is added there is no gaseous evolution. The frit composition range differs from normal enamel frits in that, similarly to the U.S. Pat. No. 2,900,276, it consists substantially of boron oxide and contains less that 1% by weight of silica.

Even when measures of the type described above are taken to prevent reaction between aluminium particles and the vitreous enamel slurry, gas evolution and subsequent foaming of the cermet coatings may still occur during firing, making it difficult to produce non-porous coatings. Lowering the firing temperature reduces this problem to some extent. The development of porosity may be further alleviated to some extent by adding refractory particles such as chromium dioxide (German Pat. No. 2829959) into the slurry, which are thought to maintain fissures in the coating during firing, thus enabling easy gas escape. Alternatively, a mixture of frits may be used such that one of the frits has a significantly higher softening point than the other frit, which may also leave fissures in the cermet for gas escape during firing. Even when the measures described above are adopted the final cermet coatings may be unacceptably porous.

According to the present invention a process for applying a vitreous enamel comprises; applying a powdered vitreous frit to a metal, said vitreous frit having a water content of up to 0.03% by weight; and then firing the coated metal at a temperature in excess of the melting point of the frit, in a furnace having an atmosphere with a dew point of up to 10° C.

While reduction of the water content of the frit and furnace atmosphere to these levels will significantly reduce the defects in the coatings produced when compared with coatings produced by conventional enamelling techniques, even better results may be obtained when; compositions including a vitreous frit with a water content of up to 0.03 wt % are fired in a furnace with an atmosphere having a dew point of up to 5° C. and compositions including a vitreous frit with a water content of up to 0.015 wt % are fired in a furnace with an atmosphere having a dew point of up to 10° C.

Metal particles may be added to the vitreous enamel to form a cermet. These cermet compositions may contain up to 60% by volume of metal particles. It is advantageous to use small particles preferably having a particle size of less than 200 microns.

It has been found that by reducing the water content of the frit and firing in an atmosphere with low dew point, as proposed above the tendency towards defects associated with enamelling steel and similar metals, and in particular carbon boil and fishscale defects are significantly reduced. Furthermore the problem of gassing or foaming with cermet compositions which leads to porosity, can also be reduced significantly. This is achieved without additions of refractory particles to the enamel slip. Nor does it require the usage of special frit compositions other than those commonly used and well known in the enamelling industry. Furthermore, firing temperatures need not be restricted.

The frit used in the present invention may have a basic composition similar to those conventionally used in enamelling. The water or hydroxyl ion content is however reduced to the required level, by appropriate means. Accordingly, the water may be removed from the frit by bubbling a dry gas, for example argon, through the molten frit composition. Alternatively the molten frit could be subjected to a vacuum in order to draw off the water. It is also possible to prepare the frit composition from water free materials, for example by calcination prior to compounding, and by avoiding water pick-up during manufacture.

Water may also be removed from the frit composition by reacting the molten frit with reagents which will react with water or hydroxyl ions. With this method, care must be taken that the reagent does not react with the other constituents of the frit or that the reaction products do not adversely affect the properties of the frit.

After the frit composition has been treated to reduce the water content, it must be formed into a powder. This may be done by using dry quenching techniques for the initial stage of particle size reduction prior to conventional milling techniques. However, the frit can tolerate being quenched into water without its water content being increased significantly, provided that the temperature is quickly reduced to below the temperature at which water is able to dissolve and diffuse into the frit. This temperature, at which water pick-up becomes significant; will depend on the length of time for which the frit is in contact with the water and the frit composition, but for frits used typically on steels it is about 500° C. The frits may also be milled in water, provided that hydrated mill additions, such as clay and boric acid are not used.

The enamel and cermet compositions of the present invention may conveniently be applied to the substrate in a non aqueous system containing for example, 3% cellulose nitrate in amyl acetate. It is also possible however, to use an aqueous suspension system including a cellulosic or other polysaccharide based suspension agent, such as sodium carboxymethyl cellulose or Xanthan gum. One possible suspension agent which may be used for this purpose is a Xanthan gum, which is commercially available as "KELZAN" from Merck & Co Inc. When an aqueous suspension is used to apply a cermet, it may also be advantageous to make additions to the slip of a corrosion inhibitor, to prevent reaction of the metallic powder, This corrosion inhibitor must be substantially non-hydrated or must evolve any water of hydration at a temperature well below the softening temperature of the frit. One such corrosion inhibitor is commercially available as "FERNOX ALU" from Industrial Anti Corrosion Services Limited.

Other additives, for example pigments etc may be included in the enamel or cermet composition provided that they are non-hydrated or that they break down to lose any water content at a temperature well below the softening point of the frit.

In order to maintain the moisture content of the atmosphere in the firing furnace within the specified limits, it is necessary to use a furnace whose atmosphere can be controlled to maintain a low moisture content in the fusing zone. Electrically heated furnaces are particularly suitable for this purpose. However gas or oil fired furnaces can be used provided that the moist combustion products are effectively separated from the ware being fired. This may be done by the use of metal radiant tube heaters in which the flame and combustion products are totally enclosed. In addition the moisture content of the air within the furnace or entering the furnace must be controlled. This may, for example, be done by drying compressed air by passing it over a desiccant so that its dew point is reduced to around −40° C. and bleeding this dry air into the furance at sufficient rate to maintain the dew point of the air in the furnace below 10° C. Alternatively, the furnace could be operated in a room with controlled atmosphere.

The vitreous enamel cermet coatings of the present invention may be coated with a further vitreous enamel layer without metal particles, in order to provide a high gloss finish. In order to avoid gassing or foaming on the application of this further layer, vitreous enamel frits, with water or hydroxyl ion content below 0.03% by weight, similar to those used in the cermet layer, may be used. Where the coating is covered by a further enamel coating, the coatings may be fused in separate firings or simultaneously. Furthermore a frit of one colour having a water content of below 0.03% by weight may be incorporated into an enamel or cermet coating of another colour, formed in accordance with the present invention, for decorative purposes.

Particulate refractory materials such as silicon oxide or zirconium oxide may also be added to the coatings, particularly cermet coatings, of the present invention, in order to produce high temperature resistant coatings.

The invention is further illustrated with reference to the following examples:

In these examples the vitreous enamel frits used were based on two basic frit compositions: Frits A1, A2 and A3 were based on an acid resisting ground coat type frit of the following formulation:

| | % by weight |
|---|---|
| Silica ($SiO_2$) | 52.8 |
| Boric Oxide ($B_2O_3$) | 16.6 |
| Sodium Oxide ($Na_2O$) | 15.4 |
| Lithium Oxide ($Li_2O$) | 0.2 |
| Titanium Oxide ($TiO_2$) | 5.6 |
| Barium Oxide (BaO) | 3.8 |
| Phosphorous pentoxide ($P_2O_5$) | 0.4 |
| Cobalt Oxide (CoO) | 0.3 |
| Ferric Oxide ($Fe_2O_3$) | 0.2 |
| Fluorine ($F_2$) | 3.7 |
| Nickel Oxide (NiO) | 1.0 |

Frit A1 was the basic frit composition which had been produced by conventional techniques. The amount of water present in the frit was 0.083% by weight. This water was derived from both the raw materials used to manufacture the frit and the atmosphere of the furnace in which the frit was prepared.

For frits A2 and A3 the water content of the basic frit was reduced by bubbling dry gas through the molten frit composition. Frit A2 was produced by remelting 15kg of the basic frit at 1100° C. and bubbling 660 liters of argon containing less than 3 volumes per million of water, through the melt. The molten frit was then quenched into water in the conventional manner and dried at 150° C. for one hour. The water content of the resulting frit A2 was reduced to 0.027% by weight.

To produce frit A3 the above procedure was repeated but 2250 liters of dry argon were passed through the melt, to give a frit with a water content of 0.012% by weight.

Frits B1 and B2 were based on a white titania opacified cover coat type frit of the following composition:

| | % by weight |
|---|---|
| Silica ($SiO_2$) | 46.5 |
| Boric Oxide ($B_2O_3$) | 15.6 |
| Sodium Oxide ($Na_2O$) | 7.4 |
| Potassium Oxide ($K_2O$) | 7.4 |
| Lithium Oxide ($Li_2O$) | 0.8 |
| Titanium Oxide ($TiO_2$) | 19.0 |
| Zinc Oxide (ZnO) | 0.5 |
| Alumina ($Al_2O_3$) | 0.5 |
| Phosphorous pentoxide ($P_2O_5$) | 0.7 |
| Fluorine ($F_2$) | 1.6 |

The frit B1 was the basic composition which was produced by conventional techniques and had a water content of 0.032% by weight.

Frit B2 was prepared by treating the basic frit by bubbling 1950 liters of argon containing less than 3 volumes per million of water through 15 kg of the basic frit remelted at 1100° C. The frit was then quenched in water and dried at 150° C. for one hour. The resulting frit B2 had a water content of 0.009% by weight.

Four different types of steel substrate were used in the examples:

1. A decarburised enamelling steel commercially available as "Vitrostaal" from Estel NV of the Netherlands;
2. An enamelling steel formed in accordance with British Standard 1449: Part 1 1972: reference CR2VE;
3. An extra deep drawing steel formed in accordance with British Standard 1449: Part 1 1972; reference CR1; and
4. A general purpose hot rolled steel formed in accordance with British Standard 1449: Part 1 1972 reference HR4.

The compositions of these steels expressed in percent by weight are given in the following table, the balance being iron.

| | | STEEL | | |
|---|---|---|---|---|
| | Vitrostaal | CR2VE | CRI | HR4 |
| Carbon | <0.01 | 0.016 | 0.059 | 0.060 |
| Silicon | 0.015 | 0.014 | 0.028 | <0.01 |
| Sulphur | 0.010 | 0.012 | 0.010 | 0.012 |
| Phosphorous | 0.006 | 0.007 | 0.005 | 0.021 |
| Manganese | 0.037 | 0.39 | 0.30 | <0.29 |
| Chromium | 0.10 | 0.09 | 0.06 | 0.01 |
| Nickel | <0.01 | <0.01 | <0.01 | 0.02 |
| Molybdenum | <0.01 | <0.01 | <0.01 | 0.01 |
| Titanium | 0.01 | 0.01 | 0.01 | 0.01 |
| Niobium | 0.007 | 0.004 | 0.007 | <0.01 |
| Copper | 0.011 | 0.03 | 0.006 | 0.03 |
| Cobalt | 0.012 | 0.012 | 0.008 | 0.01 |
| Aluminium | 0.008 | 0.007 | 0.081 | 0.039 |

Both the decarburised enamelling steel "Vitrostaal" and CR2VE enamelling steel were produced by ingot casting of rimming steels and were converted to 0.7 mm sheet by first hot rolling and finally cold rolling with interstage annealing, in such a manner as to minimise the tendency for fishscale defects when used for enamelling. The decarburised enamelling steel had also been decarburised by annealing in a wet hydrogen atmosphere.

The extra deep drawing steel CR1 was produced by the ingot casting of an aluminium killed steel which was subsequently converted into 1 mm sheet by first hot rolling and finally cold rolling with interstage annealing, in such a manner as to produce the optimum deep drawing characteristics. Steel of this type is normally prone to produce fishscale defects when conventional enamelling techniques are used.

The general purpose hot rolled steel HR4 was produced by continuous casting aluminium killed steel into a bloom and subsequently converting it into 3 mm plate by hot rolling only. Steel of this type is normally extremely prone to producing fishscale defects when convential enamelling techniques are used.

Unless specified otherwise, the frits were applied to the steel substrates in the form of an aqueous slurry. The slurries were prepared by wet milling in a ball mill in the normal manner until 99% by weight of the frit was of a particle size of less than 38 microns. The mill formulation used was:

| | |
|---|---|
| Frit | 1.2 kg |
| Water | 600 ml |
| Xanthan Gum suspension agent | 3.0 g |
| Sodium Nitrite | 12.0 g |

Where metal powder additions were made to the slurry these were thoroughly mixed into the slurry together with 4% by volume (on the basis of the total volume of the slurry) of "Fernox Alu" inhibitor. The percentage by weight of the metal powder was based on the total of solids present in the final slurry.

EXAMPLES I and II

Aqueous slurries of frits A1 and A3 were sprayed onto plates of HR4 hot rolled steel that had been cleaned by grit blasting only. The coatings were dried for 10 minutes at 120° C. and then fired for 6 minutes at 850° C. in a furnace the atmosphere of which had a dew point of 15° C. The resulting enamel coatings exhibited extensive fishscale defects, as illustrated in FIGS. 1 and 2 respectively.

EXAMPLE III

Example I was repeated using an aqueous slurry of frit A3, but the dried coating was fired for 6 minutes at 850° C. in a furnace with atmosphere of dew point 0° C. The resulting coating exhibited a full gloss and was entirely free from fishscale defects, as illustrated in FIG. 3.

EXAMPLE IV

An aqueous slurry of frit A1 was sprayed onto a sample of CR2VE enamelling steel, the surface of which had previously been treated by etching and nickel flash coating. The sample was dried for 10 minutes at 120° C. and fired for 3 minutes at 830° F. in a furnace with atmosphere having a dew point of 5° C. The coating produced was free from fishscale defects but exhibited carbon boil defects in the form of black specks which were distributed extensively over the sample, see FIG. 4.

EXAMPLES V and VI

Aqueous slurries of frit A3 were sprayed onto samples of decarburised enemelling steel and CR2VE enamelling steel that had been pretreated by etching and nickel flash coating. The samples were dried for 10 minutes at 120° C. and fired for 3 minutes at 830° C. in a furnace with atmosphere having a dew point of 5° C., in the same manner as example IV. The coatings produced in these examples were again free from fishscale defects, but in both cases only exhibiting a very light scattering of black specks due to carbon boil defects, see FIGS. 5 and 6.

Microscopic examination of cross sections through the samples produced in examples IV, V and VI showed that the black specks present in the coatings were associated with gas evolution at the steel surface which had caused discoloured enamel from near the steel surface to be swept up into the coating. The extent of residual gas bubbles at the enamel/steel interface was noticably less in coatings produced in Examples V and VI from frit A3.

EXAMPLES VII to XV

Aqueous slurries were prepared from frits A1, A2 and A3; each contaning 15% by weight of aluminium powder of particle size up to 50 microns. Each slurry was sprayed onto three sample plates made from decarburised enamelling steel that had been degreased only. The coatings on each sample plate were dried in air at 120° C. for 10 minutes. One sample plate with each frit coating was then fired for 3 minutes at 810° C. in furnaces with atmospheres having dew points of 15° C., 7° C. and −5° C. respectively. In each case the amount of fused coating present on the plates was around 350g per square meter of steel surface.

None of the enamel coatings produced exhibited any fishscaling defects, but all were porous due to gas evolution during the firing process. The degree of porosity however increased with increase in water content of the frit and furnace atmosphere as indicated in the table below. The surface appearance of the coating also varied with the extent of gas evolution during the firing process.

In the following table the porosity figures are given as a percentage by volume and were determined by quantitative metallography of polished cross sections through the coatings when examined at a magnification of X200.

| Example | Frit | Dew Point | Porosity | Surface Appearance |
|---|---|---|---|---|
| VII | A1 | 15° C. | 43% (see FIG. 7) | rough and blistered |
| VIII | A2 | 15° C. | 30.3% (see FIG. 8) | rough matt finish |
| IX | A3 | 15° C. | 26.2% (see FIG. 9) | rough matt finish |
| X | A1 | 7° C. | 32% (see FIG. 10) | rough matt finish |
| XI | A2 | 7° C. | 22.5% (see FIG. 11) | smooth matt finish |
| XII | A3 | 7° C. | 19.5% (see FIG. 12) | smooth semi-gloss finish |
| XIII | A1 | −5° C. | 24.9% (see FIG. 13) | rough matt finish |
| XIV | A2 | −5° C. | 16.5% (see FIG. 14) | smooth semi-gloss finish |
| XV | A3 | −5° C. | 14.7% (see FIG. 15) | smooth semi-gloss finish |

EXAMPLES XVI and XVII

Aqueous slurries of frits B1 and B2 containing 15% by weight of aluminium powder having a particle size of up to 50 microns were sprayed onto plates of decarburised enamelling steel that had been etched and nickel flash plated. The coatings were dried at 120° C. for 10 minutes and then fired for 3 minutes at 810° C. in a furnace with an atmosphere having a dew point of 0° C. In each case the amount of fused coating present on the plates was around 350g per meter of steel surface. The porosity of the coatings was measured as described in Example VII.

| Example | Frit | Dew Point | Porosity | Surface Appearance |
|---|---|---|---|---|
| XVI | B1 | 0° C. | 28.4% (see FIG. 16) | rough matt finish |
| XVII | B2 | 0° C. | 3.0% (see FIG. 17) | smooth semi-gloss finish |

EXAMPLES XVIII to XX

Aqueous slurries of frit A3 containing 5%, 10% and 30% by weight of aluminium powder of particle size up to 50 microns, were sprayed onto plates of HR4 hot rolled steel that had been cleaned by grit blasting. These coatings were dried for 10 minutes at 120° C. and fired for 6 minutes at 850° C. in a furnace with atmosphere having a dew point of 0° C.

None of the coatings produced exhibited any fishscale defects or blisters of the type normally found when such steel is enamelled and all the coatings were strongly adhered to the steel substrate. The surface appearance of the coatings is given below:

| Example | % of powder | Surface Appearance |
|---|---|---|
| XVIII | 5 | Smooth gloss finish (comparable with conventional enamel) |
| XIX | 10 | Smooth semi-gloss finish |
| XX | 30 | Smooth matt finish |

EXAMPLES XXI and XXII

Aqueous slurries of frits A1 and A3 containing 15% by weight of zirconium powder of particle size up to 50 microns, were sprayed onto plates of decarburised enamelling steel that had been pre-treated by etching and nickel flash coating. The coatings were dried for 10 minutes at 120° C. and fired for 4 minutes at 810° C. in a furnace with an atmosphere having a dew point of 0° C. The coating produced in Example XXI from frit A1, was rough and blistered in appearance; while that produced in Example XXII from frit A3, was smooth with a gloss finish. Microscopic examination of the structure of the coatings revealed that the rough blistered appearance of the example XXI was associated with porosity around the zirconium particles (see FIG. 18) while with example XXII the enamel was closely adhered to the zirconium particles (see FIG. 19). In addition to the improvement in the appearance of the coating the more coherent nature of the frit A3 coating would probably also improve the strength of the coating.

EXAMPLES XXIII and XXIV

Aqueous slurries of frits A1 and A3 containing 15% by weight of titanium powder of particle size up to 50 microns, were sprayed onto plates of decarburised enamelling steel that had been pre-treated by etching and nickel flash coating. The coatings were dried for 10 minutes at 120° C. and fired for 4 minutes at 810° C. in a furnace with an atmosphere having a dew point of 0° C. Both examples produced smooth coatings with gloss finish. However, microscopic examination of the structure of the coatings revealed that in example XXIII incorporating frit A1 porosity was apparent around the titanium particles (see FIG. 20) while with example XXIV incorporating frit A3 the enamel was closely adhered to the titanium particles (see FIG. 21). The more coherent nature of the frit A3 coating will result in an improvement in the strength of the coating.

EXAMPLE XXV

Frit A3 was milled to produce an aqueous slurry in the manner described hereinbefore, except that the mill formulation was varied as follows:

| | |
|---|---|
| Frit | 1.2 kg |
| Water | 600 ml |
| Sodium Carboxymethylcellulose (suspension agent) | 8 g |
| Sodium nitrite | 12 g |

15% by weight aluminium powder of particle size up to 50 microns together with 4% by volume of "Fernox Alu" inhibitor were mixed into the slurry. This aqueous slurry was sprayed onto a plate of CR2VE enamelling grade steel that had been pre-treated by etching and nickel flash coating. The coating was dried for 10 minutes at 120° C. and fused for 3 minutes at 810° C. in a furnace with a dew point of 0° C. The coating produced was comparable with that produced in Example XII being smooth and semi-gloss in appearance and free from blisters.

EXAMPLE XXVI

Frit A3 was milled to produce an aqueous slurry in the manner described hereinbefore except that a conventional mill formulation of the following composition was used:

| | |
|---|---|
| Frit | 1.2 kg |
| Water | 600 ml |
| White enamelling clay (suspension agent) | 72 g |
| Boric acid | 72 g |
| Sodium nitrite | 0.6 g |

15% by weight of aluminium powder having a particle size of up to 50 microns was mixed into the slurry. The aqueous slurry was sprayed onto a plate of CR2VE enamelling grade steel that had been pre-treated by etching and nickel flash coating. The coatings were dried for 10 minutes at 120° C. and fired for 3 minutes at 810° C. in a furnace with atmosphere having a dew point 0° C. The resulting coating was rough and blistered and of similar appearance to that produced in Example VII.

EXAMPLE XXVII

Frit A3 was dry milled in a ball mill until 99% by weight of the frit was of a particle size less than 38 microns. The dry powdered frit was mixed with 7.5% by weight (based on the total weight of solids) of aluminium powder having a particle size of up to 50 microns and formed into a slurry with a solution of 3% by weight cellulose nitrate in amyl acetate. The non-aqueous slurry was sprayed onto a plate of degreased CR2VE enamelling grade steel and allowed to dry in a well ventilated area at ambient temperature. The plate was subsequently fused for 4 minutes at 810° C. in a furnace with atmosphere having a dew point of 5° C. The resulting coating showed no tendency to foam or blister and produced a strongly adhered, impervious, strong coating of a smooth semi-gloss appearance similar to that produced in Example XV.

EXAMPLES XXVIII and XXIX

Two plates of HR4 hot rolled steel were coated and fired with layers of frit A3 containing 30% by weight aluminium powder as described in Example XX.

Aqueous slurries of frits A1 and A3 were sprayed onto the coated plates. These were allowed to dry for 10 minutes at 150° C. and fired for 6 minutes at 850° C. in a furnace with atmosphere having a dew point of 0° C. The coating resulting from Example XXVIII in which the overcoat was frit A1 was rough with excessive blistering; whereas the coating resulting from Example XXIX where the overcoat was frit A3, had a surface appearance comparable with that of Example III, that is, a smooth full gloss finish free from any blistering or fishscale defects.

EXAMPLE XXX

An aqueous slurry of frit A3 containing 15% by weight of aluminium powder of particle size up to 50 microns was sprayed onto a degreased plate of decarburised enamelling grade steel. Whilst the coating was still wet a second application of an aqueous slurry of frit A3, without metal addition, was sprayed onto the plate. The sample was dried for 10 minutes at 120° C. and fired for 3 minutes at 810° C. in a furnace with atmosphere of dew point 0° C. The resulting coating was strongly adhered to the steel substrate having a surface appearance comparable with that of Example III, that is, a smooth gloss finish, free from any blistering or other surface defects.

EXAMPLES XXXI and XXXII

An aqueous slurry of frit A3 containing 10% by weight aluminium powder of particle size up to 50 microns was prepared as disclosed hereinbefore. This slurry was divided into two parts. To the first part, an addition was made of ½% by weight of frit B1 that had been dry milled to a particle size of between 75 microns and 250 microns. To the second part, addition was made of ½% by weight of frit B2 that had been dry milled to a particle size of between 75 microns and 250 microns. The slurries were sprayed onto plates of CR1 deep drawing steel that had previously been degreased. The coatings were dried for 10 minutes at 120° C. and fired for 4 minutes at 850° C. in a furnace having an atmosphere with a dew point of 5° C. Both coatings were strongly adhered to the steel substrate and free from fishscale defects that are frequently encountered when steel of this type is enamelled. However, Example XXXI which contained frit B1 particles had a large number of small blisters on its surface that were associated with the frit B1 particles (see FIG. 22). Example XXXII which contained frit B2 particles was of an attractive appearance having a black semi-matt finish with a large number of white flecks which were produced by the frit B2 particles (see FIG. 23).

EXAMPLE XXXIII

An aqueous slurry was formed from frit A3 to which was added 15% by weight of aluminium powder having a particle size of up to 50 microns and 12% by weight of silcon oxide powder having a particle size of up to 50 microns, This slurry was sprayed onto a sample of degreased decarburised enamelling steel. The coating was allowed to dry for 10 minutes at 120° C. and was then fired for 3 minutes at 810° C. in a furnace with atmosphere having a dew point of 0° C. The resulting coating was strong and impervious with a smooth semi-matt finish.

In the accompanying drawings referred to in the above examples:

FIGS. 1 and 2 show the fishscale defects 10 (FIG. 1) that resulted from the coatings produced in accordance with examples I and II respectively. No fishscale defects are present in FIG. 3 which shows the coating produced in accordance with example III.

FIGS. 4 to 6 show the distribution of carbon boil defects in the form of black specks 11 (FIG. 4) of the coatings formed in accordance with examples IV to VI respectively.

Figure 3:
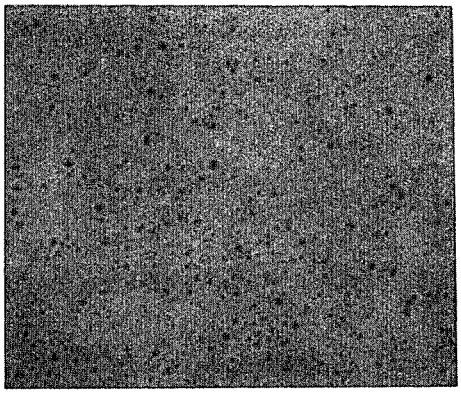
FIGS. 1 to 6 are magnified photographs of the surfaces of the coatings produced in accordance with Examples I to VI respectively.
Figure 2:
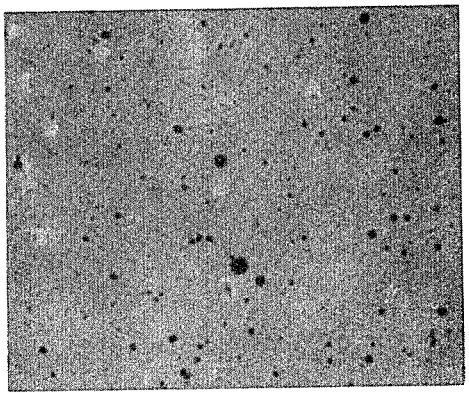
Figure 1:
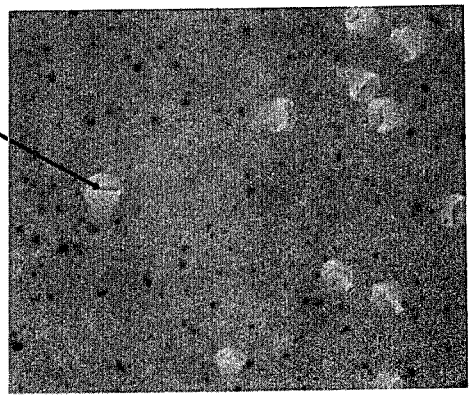
Figure 6:
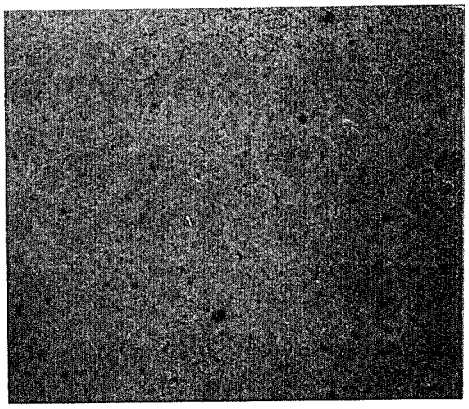
Figure 5:
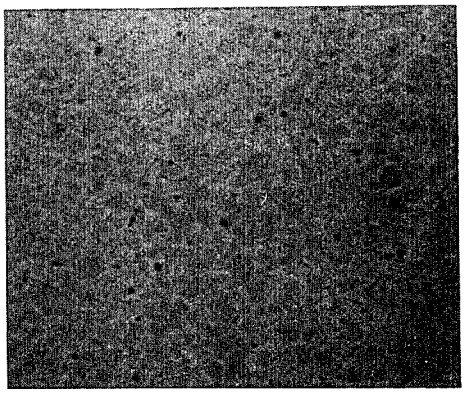
Figure 4:
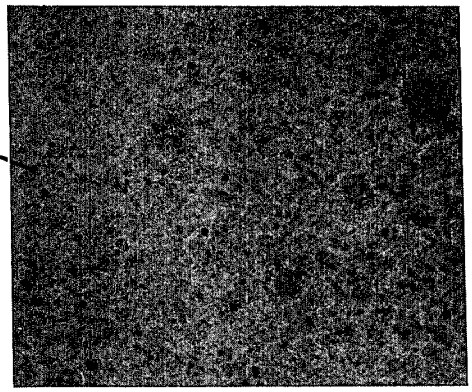
Figure 7:
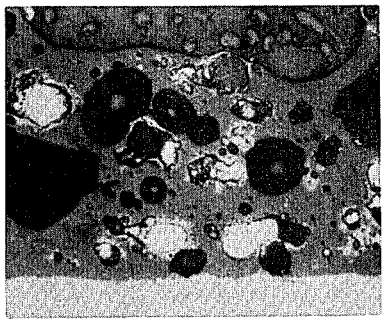
FIGS. 7 to 17 are optical microscopic photographs of sections through the coatings produced in accordance with Examples VII to XVII respectively.
Figure 10:
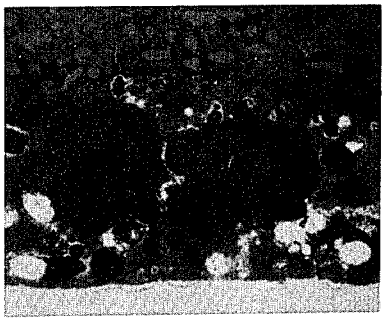
Figure 8:
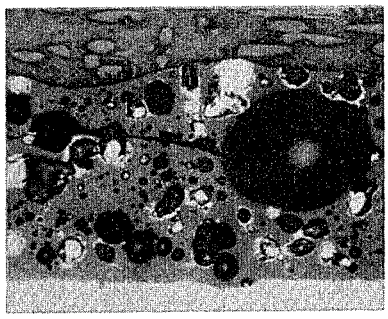
Figure 11:
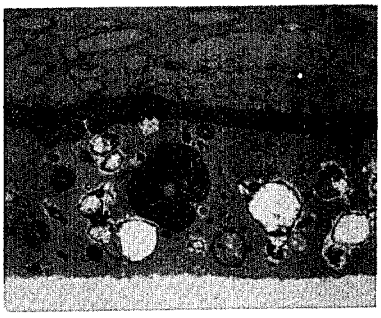
Figure 9:
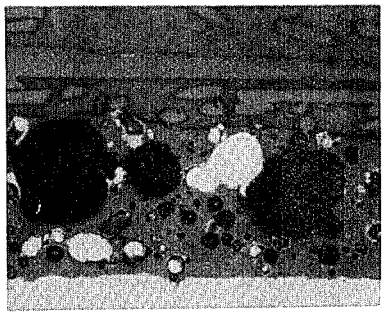
Figure 12:
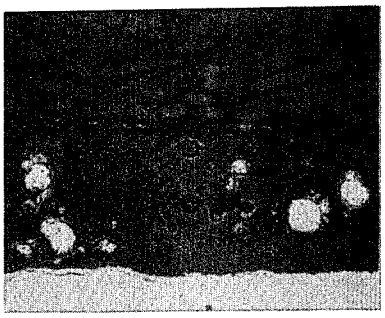
Figure 13:
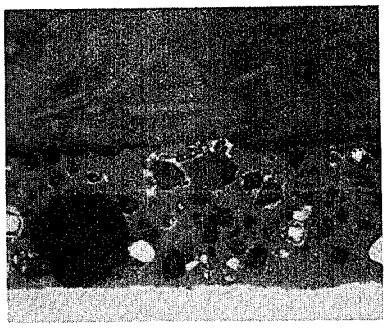
Figure 16:
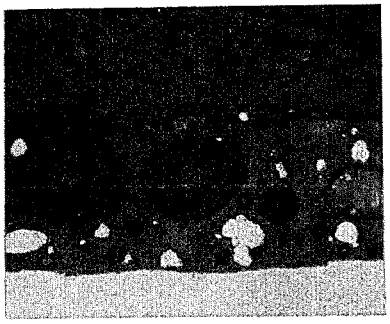
Figure 14:
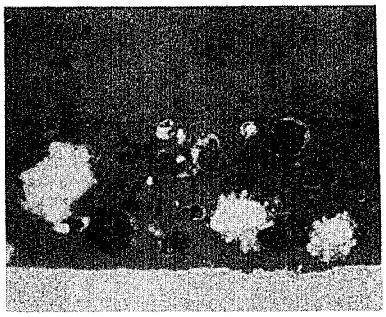
Figure 17:
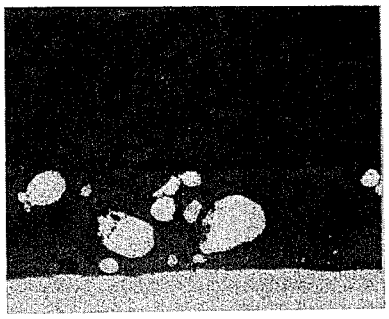
Figure 15:
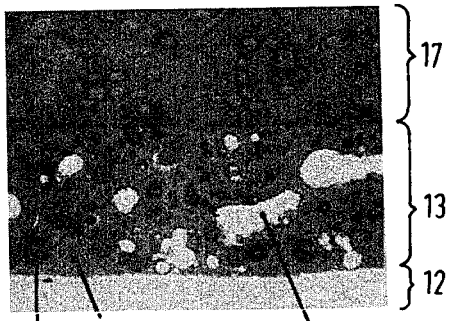
Figure 19:
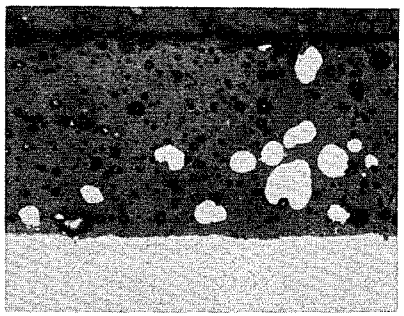
FIGS. 18 to 21 are optical microscopic photographs of sections through the coatings produced in accordance with Examples XXI to XXIV respectively.
Figure 21:
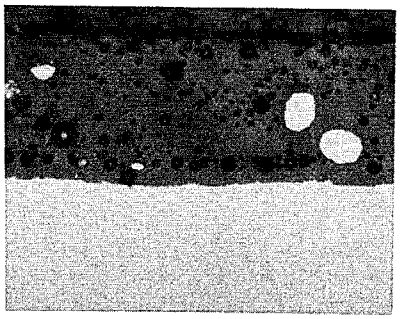
Figure 18:
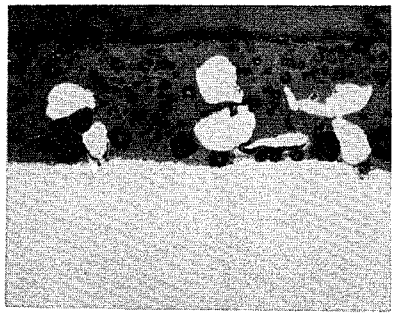
Figure 20:
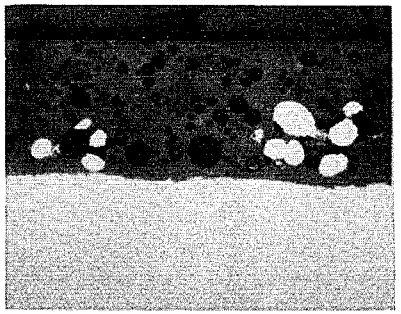

As illustrated in FIG. 15, the cross-sections shown in FIGS. 7 to 17 show the steel substrate 12 and the cermet layer 13. The cermet layer 13 includes metal particles 14, the glass or frit mitrix 15 and gas bubbles 16. The gas bubbles 16 fall into two categories (i) the small bubbles which are inherent in all enamel layers and are caused by the entrapment of gases between the frit particles during firing; and (ii) the large bubbles which are caused by gas evolution at the metal/frit interface. It is clear from FIGS. 7 to 17 that as the water content of the frit and furnace atmosphere are reduced, the porosity due to gas evolution at the metal/frit interface also reduces.

The dark layer 17 above the cermet layer 13 in these figures is a mounting compound. It is also apparent from FIGS. 7 to 17 that the surface of the samples produced in accordance with the present invention, that is as shown in FIGS. 11, 12, 14, 15 and 17, are generally smoother than the surfaces of the examples outside the invention.

Figure 23:
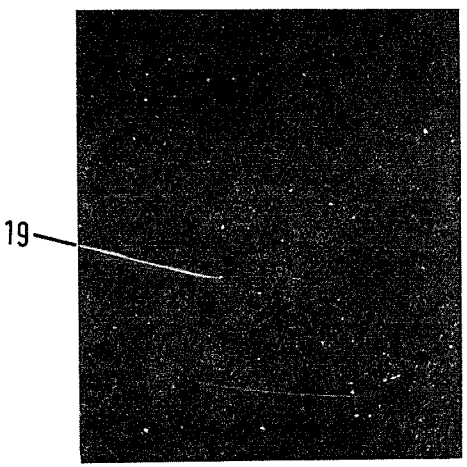
FIGS. 22 and 23 are magnified photographs of the surface of the coatings produced in accordance with Examples XXXI and XXXII respectively.
Figure 22:
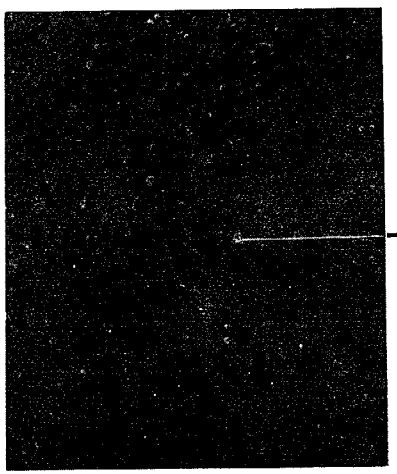

FIG. 22 shows the blisters 18 that are produced by the introduction of particles of frit B1 in examples XXXI and FIGS. 23 shows the white flecks 19 produced by the introduction of particles of frit B2 in example XXXII.

While the description above has concentrated on the benefits of the application of enamel frits onto steel substrates or to the application of cermet composition including aluminium, similar benefits will be gained when enamelling other substrates or applying cermet compositions with other metal additions. The method disclosed is particularly suitable where either the substrate or the particulate metal additive has a high affinity for oxygen, for example, iron, aluminium, magnesium, titanium, zirconium, silicon and their alloys. The method may however be used with any high melting point substrate, for example, metal or ceramic.

In addition to coatings for metal or non-metallic substrates, the present invention also covers glass/metal composites in which, for example, the glass acts as a matrix for metal particles.

We claim:

1. A process for applying a vitreous enamel comprising; applying a powdered vitreous frit to a metal, said vitreous frit having a water content of up to 0.03% by weight; and then firing the coated metal at a temperature in excess of the melting point of the frit, in a furnace having an atmosphere with a dew point of up to 10° C.

2. A process according to claim 1 in which the frit has a water content of up to 0.015% by weight and the dew point of the furnace atmosphere is up to 10° C.

3. A process according to claim 1 in which the frit has a water content of up to 0.03% by weight and the dew point of the atmosphere is up to 5° C.

4. A process according to claim 1 in which powdered metal is admixed with the powdered vitreous frit.

5. A process according to claim 4 in which the powdered metal has a particle size of up to 200 microns.

6. A process according to claim 4 in which up to 60% by weight of powdered metal is added to the powdered frit.

7. A process according to claim 1 in which the metal is selected from iron, aluminium, magnesium, titanium, zirconium, silicon, and their alloys.

8. A process according to claim 1 in which the powdered vitreous enamel is applied as a coating to a substrate.

9. A process according to claim 8 in which the coating is applied to the substrate in the form of a non-aqueous slurry.

10. A process according to claim 8 in which the coating is applied to the substrate in the form of an aqueous slurry, said aqueous slurry including a polysaccharide based suspension agent.

11. A process according to claim 10 in which the aqueous slurry includes a cellulosic suspension agent.

12. A process according to claim 10 in which the suspension agent is a xanthan gum.

13. A process according to claim 8 in which a second coating of powdered vitreous frit is applied to the substrate, the frit in said second coating having a water content of up to 0.03% by weight, said second coating being fired at a temperature in excess of the melting point of the frit, in a furnace having an atmosphere with a dew point of up to 10° C.

14. A process according to claim 13 in which the second coating is applied before the first coating has been fired and the first and second coatings are fired simultaneously.

15. A process according to claim 1 in which powdered refactory material is admixed with the powdered vitreous frit.

* * * * *

REEXAMINATION CERTIFICATE (1160th)

United States Patent [19]

Mumford et al.

[11] B1 4,555,415

[45] Certificate Issued Nov. 28, 1989

[54] VITREOUS ENAMELS

[75] Inventors: John L. Mumford, Saffron Walden; Roger F. Price, Haverhill, both of England

[73] Assignee: TI (Group Services) Limited, Birmingham, England

Reexamination Request:
No. 90/001,480, Apr. 4, 1988

Reexamination Certificate for:

| | |
|---|---|
| Patent No.: | **4,555,415** |
| Issued: | **Nov. 26, 1985** |
| Appl. No.: | **683,617** |
| Filed: | **Dec. 19, 1984** |

[30] Foreign Application Priority Data

Dec. 21, 1983 [GB] United Kingdom ..... 8334118

[51] Int. Cl.[4] ..... B05D 3/02

[52] U.S. Cl. ..... 427/193; 427/201; 427/376.2; 427/376.3; 427/376.4

[56] References Cited

U.S. PATENT DOCUMENTS 4,265,929 5/1981 Wagner et al. ..... 427/33

FOREIGN PATENT DOCUMENTS 479828 8/1975 U.S.S.R. .
762004 11/1956 United Kingdom .

OTHER PUBLICATIONS

D. G. Moore et al, Journal of the American Ceramic Society, Feb. 1, 1952, pp. 33–41, Relative Importance of Various Sources of Defect-Producing Hydrogen Introduced into Steel During the Application of Porcelain Enamels.

R. P. McCook, Proceedings of the Porcelain Enamel Institute, 1954, vol. 16, Addition of Water to Furnace Atmosphere.

B. W. King, Jr. et al, Proceedings of the Porcelain Enamel Institute, 1969, vol. 31, Firing Porcelain Enamels in Combustion Atmospheres.

C. E. Chaille et al, Ceramic Bulletin, 1969, vol. 48, No. 6, Effect of Water Vapor in the Furnace Atmosphere on a One-Coat White Porcelain Enamel.

J. F. Benzel et al, Journal of the American Ceramic Socity, 1961, pp. 1–6, Effect of Moisture in Furnace Atmosphere During Ground-Coat Firing.

J. D. Sullivan et al, Journal of the American Ceramic Society, 1962, pp. 509–512, Effect of Moisture in Furnace Atmosphere on Hydrogen Defects in Glass--Coated Steel.

Spencer-Strong, Journal of the American Ceramic Society, 1939, pp. 255–260, Effect of Furnace Gases on Physical Properties of Wet-Process Cast-Iron Enamels.

Sheet Metal Industries, 1952, The Source of Defect—Producing Hydrogen in Porcelain-Enameled Steel.

*Primary Examiner*—Shrive P. Beck

[57] ABSTRACT

A process for applying a vitreous enamel comprises applying a powdered vitreous frit to a metal, said frit having a water content of up to 0.03% by weight; this coated metal then being fired at a temperature in excess of the melting point of the frit, in a furnace having an atmosphere with a dew point of up to 10° C. Metal particles may be admixed with the powdered frit to form a cermet or glass/metal composite. The powdered frit may be applied to a substrate as a non-aqueous slurry or an aqueous slurry including a polysaccharide based suspension agent.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 4 and 9 are cancelled.

Claims 1, 5, 6, 7, 8, 10, and 15 are determined to be patentable as amended.

Claims 2, 3, 11, 12, 13 and 14, dependent on an amended claim, are determined to be patentable.

New claims 16–23 and 24 are added and determined to be patentable.

1. A process for applying a vitreous enamel comprising[;]: applying [a powdered] *an aqueous slurry* vitreous frit to a metal, said vitreous frit having *a powdered metal admixed therewith and* a water content of up to 0.03% by weight; and then firing the coated metal at a temperature in excess of the melting point of the frit, in a furnace having an atmosphere with a dew point of up to 10° C.

5. A process according to claim [4] *1* in which the powdered metal has a particle size of up to 200 microns.

6. A process according to claim [4 in which] *1, wherein the slurry contains* up to 60% by weight of *the* powdered metal, *based upon the weight of the glass* [is added to the powdered] frit.

7. A process according to claim 1 in which the metal is selected from iron, [aluminium] *aluminum*, magnesium, titanium, zirconium, silicon, and their alloys.

8. A process according to claim 1 in which the [powdered vitreous enamel] *aqueous slurry vitreous frit* is applied as a coating to a substrate.

10. A process according to claim 8 in which the [coating is applied to the substrate in the form of an aqueous slurry, said] aqueous slurry [including] *includes* a polysaccharide based suspension agent.

15. A process according to claim 1 in which powdered refractory material is admixed with the [powdered] vitreous frit.

*16. A process for applying a vitreous coating to a metal substrate, comprising the steps of:*

*(a) providing a powdered vitreous enamel frit by the steps of preparing a glass melt, drying the glass melt to a water content of up to 0.03 percent by weight and quenching the dried glass melt in water;*

*(b) suspending the powdered frit in water and thereby forming a slurry and admixing with the slurry a powdered metal;*

*(c) coating a metal substrate with the slurry; and,*

*(d) firing the coated substrate at a temperature in excess of the melting point of the frit in a furnace having a controlled atmosphere with a dew point of up to 10° C.*

*17. The process of claim 16, including the step of:*

*(a) drying the glass melt to a water content of up to 0.015 percent by weight.*

*18. The process of claim 16, including the step of:*

*(a) controlling the furnace atmosphere dew point at a value of up to 5° C.*

*19. The process of claim 16, including the steps of:*

*(a) coating the coated substrate with a second slurry comprising a powdered frit and water and wherein the powdered frit in the second slurry has a water content of up to 0.03 percent by weight; and,*

*(b) firing the second coating at a temperature in excess of the melting point of the frit of the second slurry in a furnace having an atmosphere with a dew point of up to 10° C.*

*20. The process of claim 19, including the step of:*

*(a) simultaneously firing the first and second coatings.*

*21. The process of claim 16, including the step of:*

*(a) admixing a powdered refractory material with the powdered frit of the second slurry.*

*22. A process for applying a low porosity cermet coating to a metal substrate, comprising the steps of:*

*(a) coating a substrate with an aqueous slurry vitreous enamel frit comprising up to 60 percent by weight of a powdered metal in admixture therewith, the powdered metal having a particle size of up to 200 microns and the frit having a water content of up to 0.03 percent by weight; and,*

*(b) firing the coated substrate at a temperature in excess of the melting point of the frit in a furnace wherein the moisture content of the atmosphere thereof is controlled and maintained at a dew point of up to 10° C.*

*23. The process of claim 22, including the step of:*

*(a) selecting the powdered metal from the group consisting of iron, aluminum, magnesium, titanium, zirconium, silicon and their alloys.*

*24. The process of claim 22, including the step of:*

*(a) incorporating into the slurry a polycaccharide based suspension agent.*

* * * * *